US006295936B1

(12) United States Patent
Dahlstrom

(10) Patent No.: US 6,295,936 B1
(45) Date of Patent: Oct. 2, 2001

(54) PORTABLE ROPE TOW DEVICE

(75) Inventor: Gale Dahlstrom, Hoquiam, WA (US)

(73) Assignee: Thin Line Concepts, Inc., Hoquiam, WA (US)

( * ) Notice: Subject to any disclaimer, the term of this patent is extended or adjusted under 35 U.S.C. 154(b) by 0 days.

(21) Appl. No.: 09/422,048

(22) Filed: Oct. 20, 1999

(51) Int. Cl.[7] ..... B61B 11/00
(52) U.S. Cl. ..... 104/173.2
(58) Field of Search ..... 104/87, 112, 114, 104/115, 173.1, 173.2, 176, 178, 180, 200, 202, 211, 222, 224, 225, 226, 227, 236, 237; 254/199, 242, 243

(56) References Cited

U.S. PATENT DOCUMENTS 495,843 * 4/1893 Shipp ..... 104/202
2,458,786 * 1/1949 Lagergren ..... 104/202
2,764,949 * 10/1956 Guthrie ..... 104/202
3,110,268 * 11/1963 Allsop ..... 104/173.2

* cited by examiner

*Primary Examiner*—Mark T. Le
(74) *Attorney, Agent, or Firm*—Christensen O'Connor Johnson Kindness PLLC

(57) ABSTRACT

A portable tow device (20) for selective attachment to a tow line (24) having a length includes a handle (32). The tow device also includes a locking member (28) rotatably attached to the handle. The locking member includes first and second bearing members (28*a*) and (28*b*) and an elongate slot (42). The tow device further includes a lever arm (30) attached to the locking member for selectively rotating the locking member between a locked position, wherein the tow line is clamped between the first and second bearing members for propelling a person along a surface at a rate substantially equal to the rate of the tow line, and an unlocked position, wherein the tow line passes freely through the tow device.

22 Claims, 4 Drawing Sheets

PORTABLE ROPE TOW DEVICE

FIELD OF THE INVENTION

The present invention relates generally to portable ski lift devices and, more particularly, to a portable hand-held rope tow device.

BACKGROUND OF THE INVENTION

Back country or out of bounds skiing, such as telemarking, is a growing aspect of outdoor activities. In certain areas, back country skiers may have set up a well-known rope tow that includes an endless rope strung between two pulleys and extending along the slope of a hill. Typically, one of the pulleys is connected to a motor, wherein the motor drives the rope between the two pulleys. In operation, a skier approaches the lower end of the rope tow located near the bottom of the hill and physically grabs onto the rope, thereby propelling the skier up the hill. Although such an arrangement is effective at propelling a skier along the slope of a hill, it is not without its problems.

First, because the skier must grab onto the moving rope with either their bare or gloved hand, the friction associated with grabbing a moving rope oftentimes results in premature wear of the glove or burns to the hands. Additionally, because the skier is forced to hold onto the rope with their hand to propel themselves up the hillside, the entire drag load associated with being propelled by the tow rope is carried by the skier's hands. As a result, the skier's hands are often prematurely fatigued. Also, because the rope used in most common rope tows is large in diameter, it is not easily transportable. Further, when the skier grabs onto the rope, there is a sudden jerking motion. This is undesirable because such a motion may cause the skier to fall. Finally, permanently attaching a well-known T-bar to the tow rope to propel a skier up the hillside is often impractical in the back country location due to the remoteness of the location and because such an apparatus requires large structure.

Thus, there exists a need for a relatively simple portable rope tow device for back country skiers.

SUMMARY OF THE INVENTION

In accordance with the present invention, a portable rope tow device for selective attachment to a tow line having a length is provided. The portable tow device includes a handle and a locking member attached to the handle. The locking member is selectively actuatable between a locked position, wherein a portion of the tow device is clamped to the tow line for propelling a person along a surface, and an unlocked position, wherein the tow line passes freely through the tow device.

In accordance with other aspects of this invention, the portable tow device also includes a lever arm attached to the locking member to selectively rotate the locking member between the locked and unlocked positions. The locking member includes first and second bearing members and an elongate slot.

In accordance with additional aspects of this invention, the elongate direction of the slot extends substantially parallel with the length of the tow line when the tow device is in the unlocked position. The elongate direction of the slot extends substantially normal to the length of the tow line when the tow device is in the locked position.

In accordance with still other aspects of this invention, the first and second bearing members are elongate cylinders and are held in spaced parallel disposition on opposite sides of the elongate slot, such that the elongate direction of each bearing member is substantially normal to the elongate direction of the slot. The first bearing member rotates about the second bearing member to clamp the tow line between the first and second bearing members when the tow device is actuated into the locked position.

In accordance with still yet other aspects of this invention, the portable tow device further includes a coupling member having a first end removably fastened to the handle and a second end selectively attachable to the person to assist in propelling the person along the surface.

A portable tow device formed in accordance with the present invention has several advantages over such devices used in the past. First, because the device is portable, it may be easily stored within a backpack carried by a skier. Further, such a device provides for a convenient method of clamping onto a tow line, thereby minimizing damage to either the gloved hand or bare hand of the skier due to frictional contact with the tow line. Additionally, such a device is adaptable by slowing increasing friction to minimize the jerking motion associated with most common tow ropes. Therefore, a portable tow device formed in accordance with the present invention is safer, more convenient and simpler to use than those currently available.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
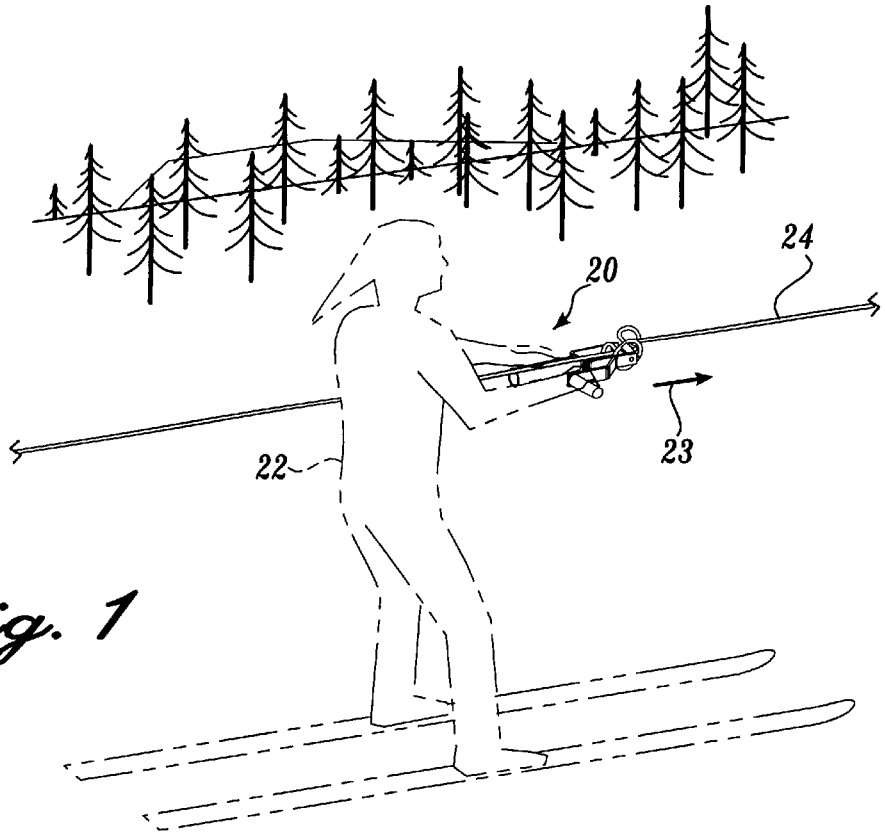
FIG. 1 is an environmental view of a portable rope tow device formed in accordance with the present invention as it would be used to propel a skier (shown in phantom) along a hillside.
Figure 2:
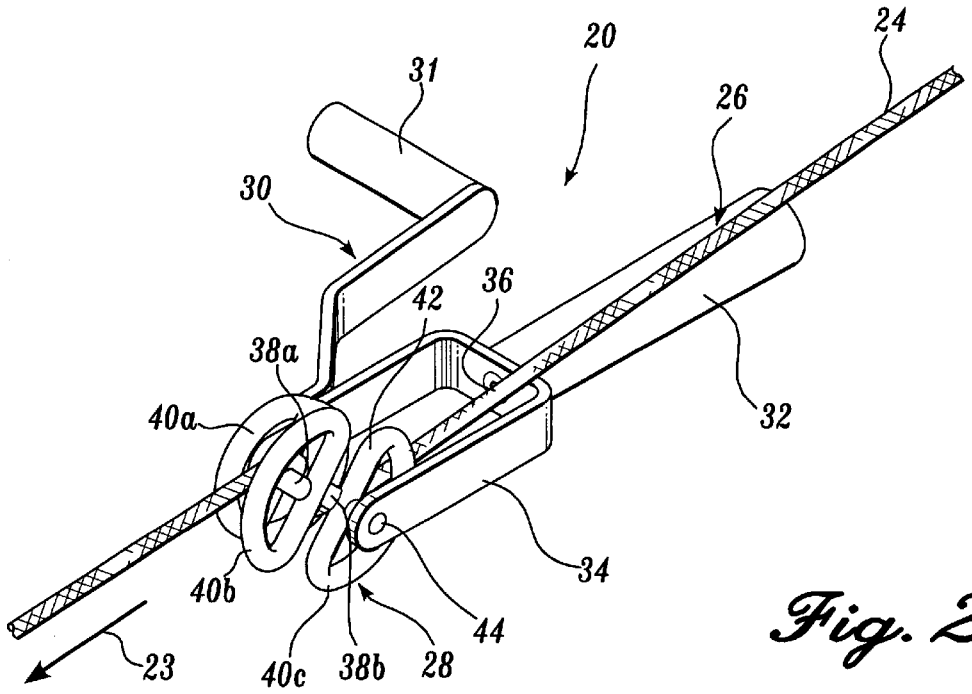
FIG. 2 is a perspective view of a portable rope tow device formed in accordance with the present invention.

FIGS. 1 and 2 illustrate a preferred embodiment of a portable tow device 20 constructed in accordance with the present invention. The tow device 20 is shown as it would be used to propel a skier 22 (shown in phantom) along a surface in the direction indicated by the arrow 23 by selectively fastening the tow device 20 to a tow rope 24. The tow rope 24 is well-known in the art and is commonly configured as an endless rope strung between two pulleys (not shown). Typically, one pulley is located at a lower portion of a hillside, while the second pulley is located at some predetermined location and elevation up the hillside. At least one of the pulleys is connected to a well-known motor (not shown) to drive the pulleys and, therefore, the tow rope 24.

As may be best seen by referring to FIG. 2, the tow device 20 includes a body 26, a locking mechanism 28 and a lever arm 30. The body 26 includes a handle 32 suitably injection-molded from a thermoplastic and an attachment member 34. The U-shaped attachment member 34 is suitably formed from a high-strength, lightweight material, such as aluminum, and is rigidly attached to one end of the handle 32 by a well-known fastener 36, such as a bolt threadably received within the handle 32. The attachment member 34 is fastened to the handle 32, such that the open end of the attachment member 34 extends outwardly away from the handle 32.

The locking mechanism 28 is suitably formed from a high-strength lightweight material, such as aluminum. The locking mechanism 28 includes first and second cylindrical bearing members 38*a* and 38*b* held in space parallel disposition by a plurality of side rings 40*a*–40*c*. The first side ring 40*a* is substantially oval in configuration and has one end of the first and second bearing members 38*a* and 38*b* integrally formed or welded substantially near its center. Both the first and second bearing members 38*a* and 38*b* extend outwardly from the first side ring 40*a* in a parallel manner, such that the elongate direction of each bearing member 38*a* and 38*b* is substantially normal to a plane extending laterally through the width of the first side ring 40*a*. The other end of each bearing member 30*a* and 30*b* has D-shaped second and third side rings 40*b* and 40*c* integrally formed therewith.

The second and third side rings 30*b* and 30*c* are integrally formed with or welded to the bearing members 38*a* and 38*b*, such that the spines of the second and third side rings 40*b* and 40*c* oppose each other. As configured, an elongate slot 42 is defined between the spines of the second and third side rings 40*b* and 40*c*. Further, the first and second bearing members 38*a* and 38*b* extend laterally between the side rings 40*a*–40*c*, such that the elongate direction of each bearing member 38*a* and 38*b* is substantially normal to the elongate direction of the slot 42.

Still referring to FIG. 2, the lever arm 30 will now be described in greater detail. The lever arm 30 is substantially L-shaped in configuration, such that the base defines a gripping portion 31 extending substantially normal to one end of the lever arm 30. The other end of the lever arm 30 is suitably bent to permit rotation of the lever arm 30 during actuation of the tow device 20 between a locked and unlocked position without interfering with the handle 32, as is described in greater detail below.

The lever arm 30 is rotatably attached to the free end of the attachment member 34 by a pin 44 extending through the free end of the attachment arm 30. The pin 44 also extends coaxially through the elongate direction of the second bearing member 38*b* to rotatably attach the locking mechanism 28 between the arms of the attachment portion 34. Thus, as assembled, the locking mechanism is pinned between the arms of the attachment portion 34, such that the first bearing member 38*a* rotates about the second bearing member 38*b* when the tow device 20 is actuated between the locked and unlocked positions, as is described in greater detail below.

Figure 3:
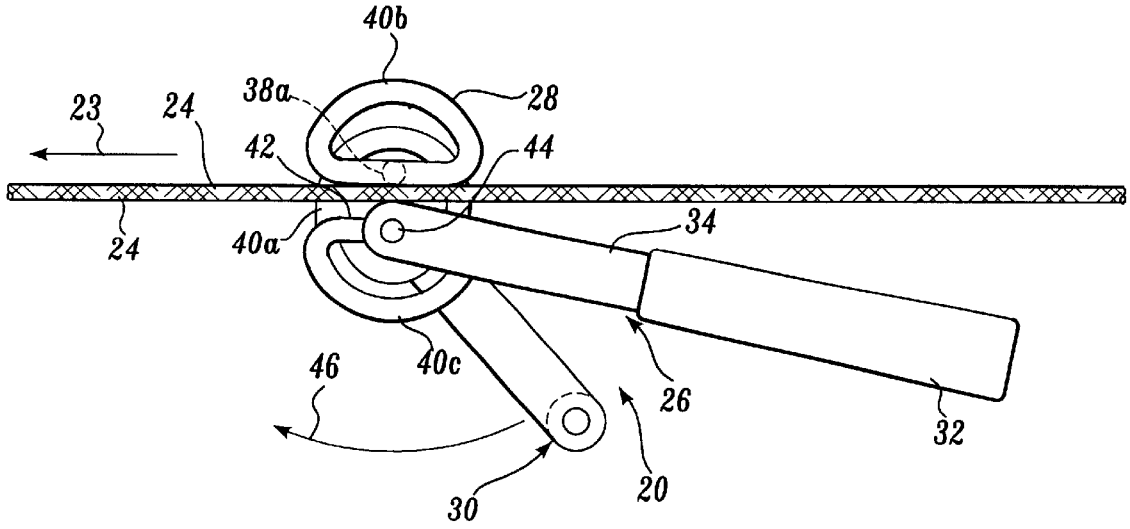
FIG. 3 is a side view of a portable rope tow device formed in accordance with the present invention shown in the unlocked position.
Figure 4:
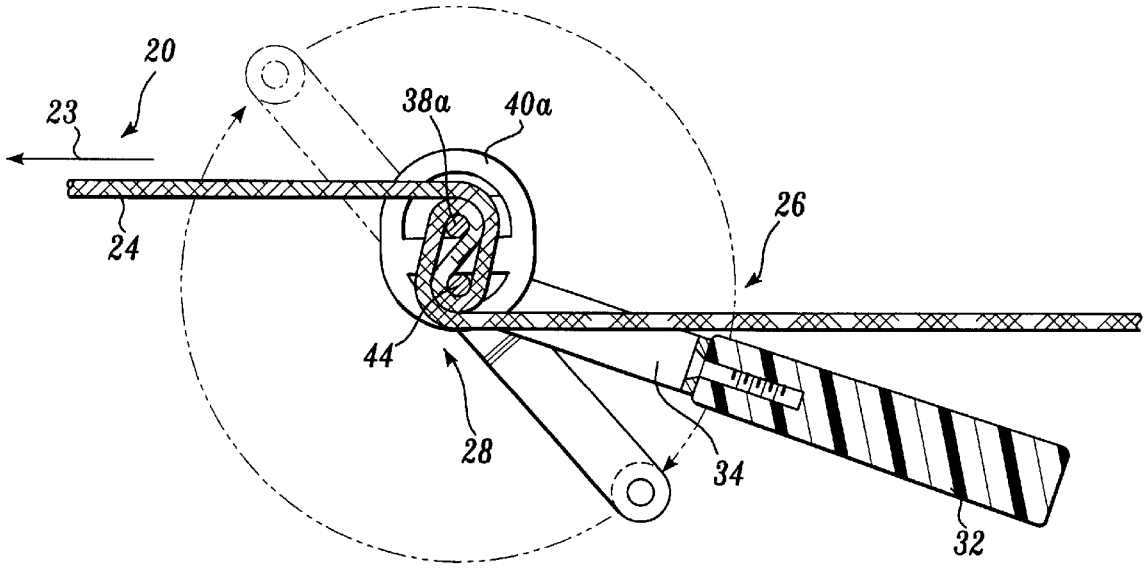
FIG. 4 is a cross-sectional side view of a portable rope tow device formed in accordance with the present invention shown in the locked position.

Operation of the portable tow device 20 may be best understood by referring to FIGS. 3 and 4. In the unlocked position (FIG. 3), the handle 32 of the tow device 20 is held in one hand of the skier, while the gripping portion 31 of the lever arm 30 is held in the other hand of the skier. The lever arm 30 is positioned towards the rearward end of the device 20, such that the first and second bearing members 38*a* and 38*b* are substantially aligned in the vertical direction. Also, in the unlocked position, the elongate direction of the slot 42 is substantially parallel with the length of the tow rope 24. As a result, the tow rope 24 may be received between the vertically aligned first and second bearing members 38*a* and 38*b* by the skier aligning the slot 42 with the length of the tow rope 24. The skier then positions the tow device 20 such that the tow rope 24 is received within the locking mechanism 28 and is located substantially midway between the sides of the locking mechanism 28. The tow device 20 is actuated into the locked position by rotating the lever arm 30 one complete revolution in either a clockwise or counterclockwise direction about the pin 44.

Referring to FIG. 4, as the locking mechanism 28 is rotated into the locked position, the first bearing member 38*a* rotates at least one complete revolution about the second bearing member 38*b* and the pin 44 to clamp the tow rope 24 between the first and second bearing members 38*a* and 38*b*. For discussion purposes, the lever arm 30 is illustrated as rotating about the pin 44 in a clockwise direction and, therefore, rotational directions and motion of various components are described accordingly. However, as noted above, the lever arm 30 may be rotated in either direction about the pin 44. Further, it is preferred that the lever arm 30 be rotated in a counterclockwise direction about the pin 44. Therefore, directional descriptions are for illustrative purposes only and the invention is not intended to be so limited.

During the actuation between the unlocked and locked positions, the first bearing member 38*a* lifts upwardly against the lower surface of the tow rope 24, thereby causing the upper surface of the tow rope 24 to engage the second bearing member 38*b*. During continued rotation of the locking mechanism 28 into the locked position, the first bearing member 38*a* continues to rotate about the second bearing member 38*b* until the tow rope 24 is securely clamped between the first and second bearing members 38*a* and 38*b*, thereby locking the tow device 20 to the tow rope 24. In this position, the tow rope 24 is doubled over onto itself to lock the tow rope 24 into place. As a result, the load associated with being towed is applied primarily to the tow device 20, instead of the lever arm 30 and, therefore, results in a more comfortable towing experience for the skier.

To actuate the tow device 20 from the locked to unlocked position, the lever arm 30 is rotated in a direction opposite from that described above for the locked position, thereby releasing the tow rope 24 from between the first and second bearing members 38*a* and 38*b*. The lever arm 30 is rotated until the elongate direction of the slot 42 is once again substantially parallel with the length of the tow rope 24, thereby permitting the skier to withdraw the tow device 20 from the tow rope 24.

Figure 5:
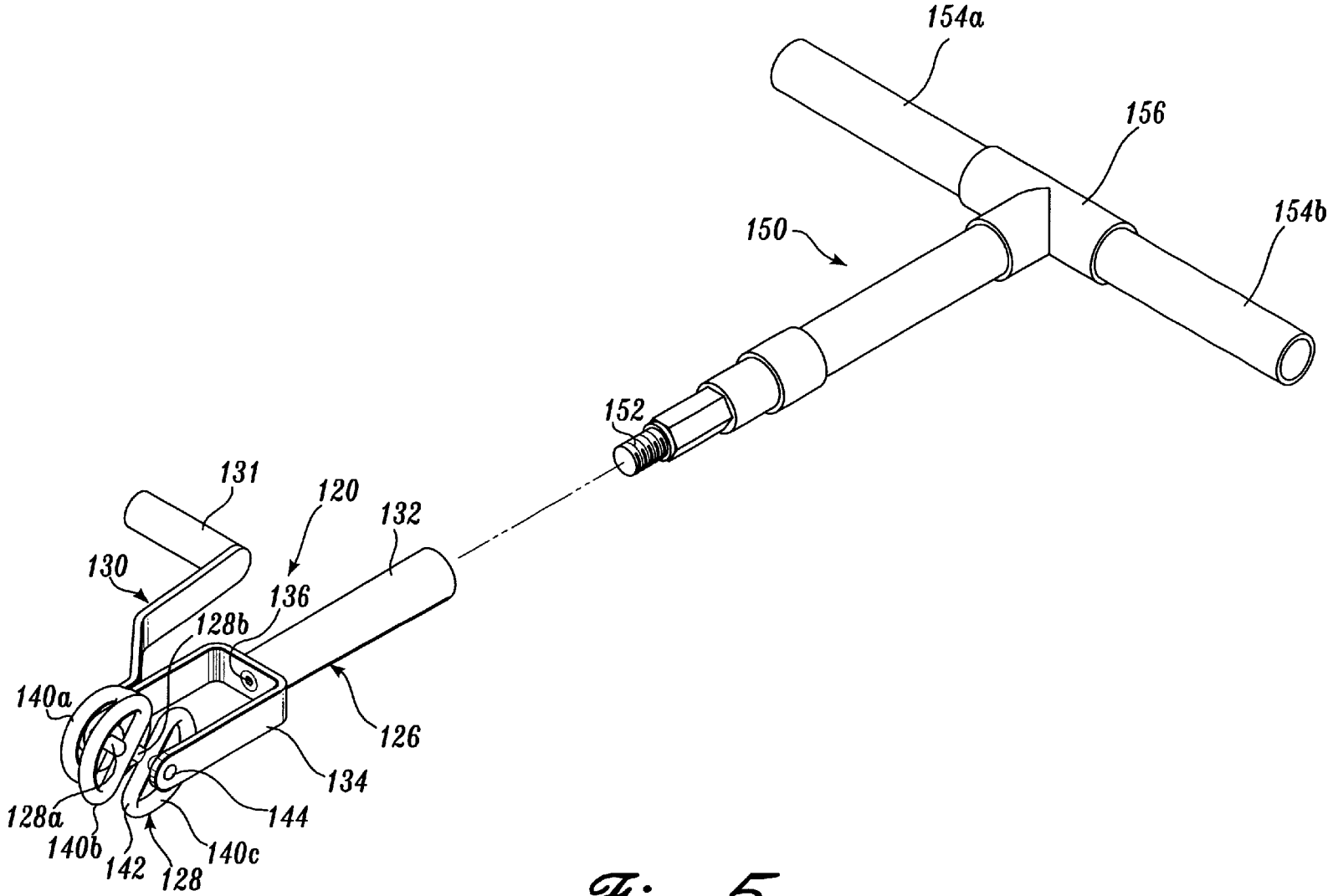
FIG. 5 is a perspective view of an alternate embodiment of a portable rope tow device formed in accordance with the present invention showing a clamping member exploded away from one end of the portable rope tow device.

Referring now to FIG. 5, an alternate embodiment of a tow device 120 constructed in accordance with the present invention will now be described in greater detail. The tow device 120 is identical in both design and operation as described above for the preferred embodiment with the following exception. The tow device 120 includes a coupling member that may be selectively fastened to the tow device 120. In this alternate embodiment, the coupling member is a T-bar 150 suitably formed from a well-known thermoplastic, such as PVC tubing. One end of the T-bar 150 includes an externally threaded portion 152 sized to be received within an internally threaded portion (not shown) located in the end of the handle 132 opposite the attachment member 134. The other end of the T-bar 150 includes first and second tubular members 154*a* and 154*b* slidably received within a T-joint 156. The tubular members 154*a* and 154*b* are sized to be received snugly against the hamstrings of a skier's legs to assist in propelling the skier along the hillside, thereby relieving at least a portion of the drag load on the skier's hands associated with being propelled by the tow rope 124.

In operation, the T-bar 150 is assembled by sliding the tubular portions 154*a* and 154*b* into the T-joint 156 and then threading the T-bar within the corresponding threaded portion of the tow device 120, thereby securing the T-bar to the tow device 120. Then, the tow device 120 is attached to the tow rope 124 as described above. The T-bar 150 is placed between the skier's legs, such that the tubular portions 154*a* and 154*b* are received against the hamstrings of the skier. Thus, the skier holds the tow device 120 in the locked position, while the T-bar 150 pulls the skier along with the tow rope 124. Although a T-bar 150 is preferred as the coupling member, other coupling members, such as a clamp device or assembly of belts, are also within the scope of the present invention.

Figure 6:
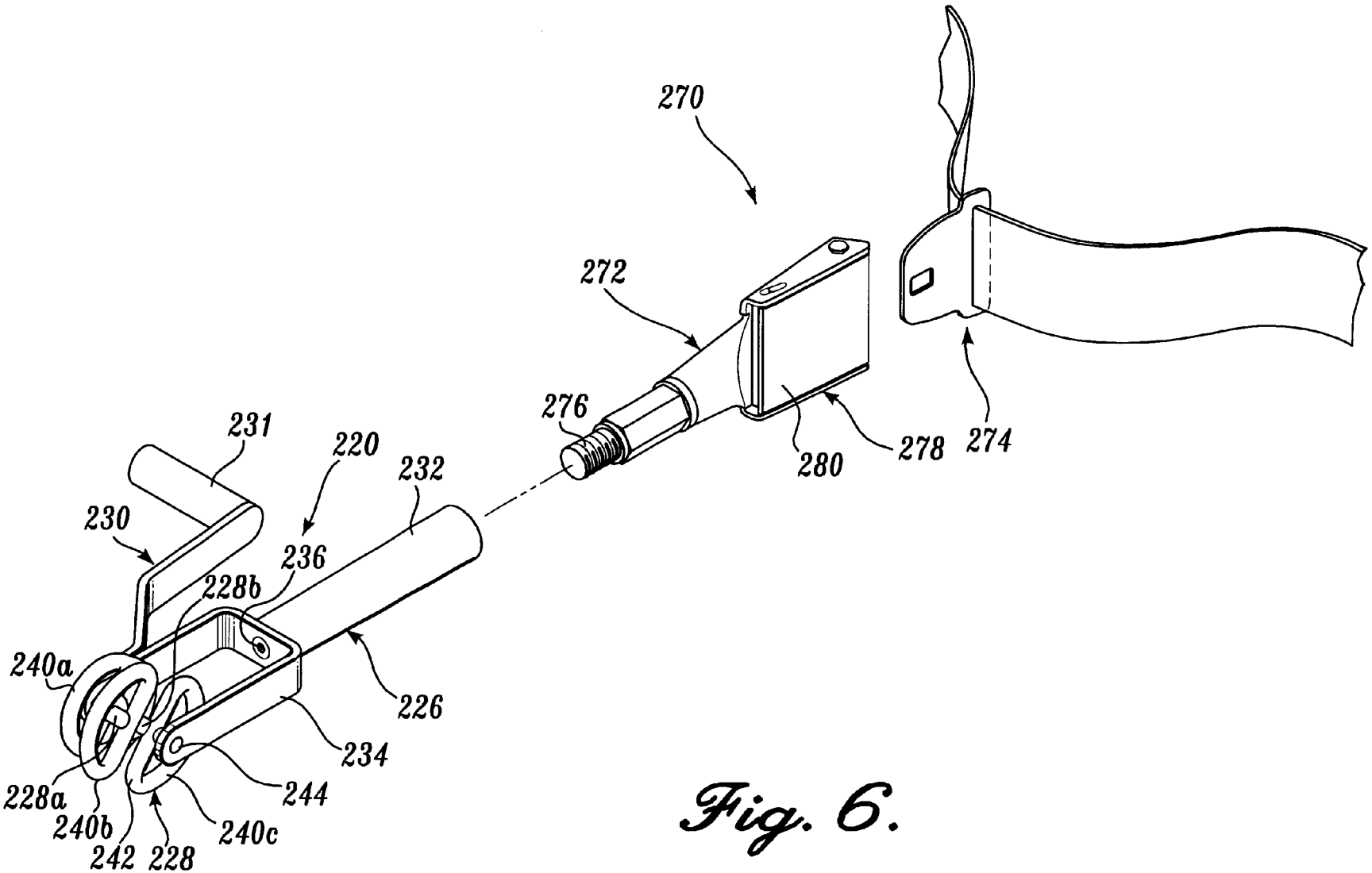
FIG. 6 is a perspective view of a second alternate embodiment of a portable rope tow device formed in accordance with the present invention showing a buckle and tab fastener attached to one end of the tow device.

Referring now to FIG. 6, a second alternate embodiment of a tow device 220 constructed in accordance with the present invention will now be described in greater detail. The tow device 220 is identical in both design and operation as described above for the preferred embodiment with the following exception. The tow device 220 includes a coupling member 270 that may be reversibly fastened to the tow device 220. In this alternate embodiment, the coupling member 270 includes a buckle portion 272 and a tab fastener 274. One end of the buckle portion 272 includes an externally threaded portion 276 sized to be received within an internally threaded portion (not shown) located in the free end of the handle 232. The other end of the buckle portion 272 includes a well-known automobile seat belt buckle 278. The buckle 278 includes a release handle 280 hingedly attached thereto to selectively release the corresponding tab fasteners 274. The tab fastener 274 is adapted to be attached to the skier by a number of attachments, such as a strap fastened to a well-known waist pack.

In operation, a skier attaches the buckle portion 272 to the tow device 220 by screwing the buckle portion 272 into the handle 232. Then, the skier would attach the tow device 220 to the tow rope 224 as described above. The buckle portion 272 is coupled to the tab fastener 274 by sliding the tab fastener 274 into the buckle portion 272. To release the tab fastener 274 from the buckle portion 272, the skier pulls the release handle 280, thereby releasing the tab fastener 272 from within the buckle portion 272. Thus, when the tab fastener 274 is received within the buckle portion 272, the skier is pulled along a surface by the tow device 220 without subjecting the skier's hand to fatigue due to the loads associated with being towed by the tow device.

The previously described versions of the present invention provide several advantages over tow devices currently available in the art. First, because the device is portable, it may be easily stored within a backpack carried by a skier. Second, such a device provides for a convenient method of clamping onto a tow line, thereby minimizing damage to either the gloved hand or bare hand of the skier due to frictional contact with the tow line. Also, if the skier should fall, the skier would let go of handle, and the pulling pressure of the tow rope will pull the device into a nonlocked position and, therefore, is safer. Therefore, a portable tow device formed in accordance with the present invention is safer, more convenient and simpler to use than those currently available.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A portable tow device for selective attachment to a towline having a length, the towline moving at a predetermined rate, the tow device comprising:

(a) a handle; and (b) a locking member rotatably attached to the handle, the locking member being selectively rotatable at least 180° about a pivot point having an axis extending normal to the length of the tow rope between a locked position, wherein the locking member is reversibly fixed to the towline locking member, and an unlocked position, wherein the towline passes freely through the tow device.

2. The portable tow device of claim 1, further comprising a lever arm attached to the locking member to selectively rotate the locking member between the locked and unlocked positions.

3. The portable tow device of claim 1, wherein the locking member comprises first and second bearing members and an elongate slot.

4. The portable tow device of claim 3, wherein the elongate direction of the slot extends substantially parallel with the length of the towline when the tow device is in the unlocked position, and the elongate direction of the slot extends substantially normal to the length of the towline when the tow device is in the locked position.

5. The portable tow device of claim 3, wherein the first and second bearing members are elongate cylinders and are held in spaced parallel disposition on opposite sides of the elongate slot, such that the elongate direction of each bearing member is substantially normal to the elongate direction of the slot.

6. The portable tow device of claim 5, wherein the first bearing member rotates about the second bearing member to clamp the towline between the first and second bearing members when the tow device is actuated into the locked position.

7. The portable tow device of claim 1, further comprising a coupling member having a first end removably fastened to the handle and a second end selectively engageable by a person to assist in propelling the person along the surface.

8. The portable tow device of claim 7, wherein the coupling member is a T-bar reversibly fastened to the handle.

9. The portable tow device of claim 7, wherein the coupling member comprises a buckle and a tab fastener, wherein the tab fastener is adapted to be selectively attached to a person and the buckle is reversibly fastened to the handle, the buckle is adapted to be releasably fastened to the tab fastener.

10. A portable tow device for selective attachment to a towline having a length and moving at a predetermined rate, the tow device comprising:

(a) a handle;

(b) a locking member rotatably attached to the handle, the locking member having at least a first bearing member and an elongate slot; and (c) a lever arm attached to the locking member for selectively rotating the locking member at least 180° degrees about a pivot point between a locked position, wherein the towline is in frictional engagement with at least the first bearing member for propelling a person along a surface at a rate substantially equal to the rate of the towline, and an unlocked position, wherein the towline passes freely through the tow device.

11. The portable tow device of claim 10, wherein the elongate direction of the slot extends substantially parallel with the length of the towline when the tow device is in the unlocked position, and the elongate direction of the slot extends substantially normal to the length of the towline when the tow device is in the locked position.

12. The portable tow device of claim 10, wherein the locking member further comprising a second bearing member, the first and second bearing members are elongate cylinders and are held in spaced parallel disposition on opposite sides of the elongate slot, such that the elongate direction of each bearing member is substantially normal to the elongate direction of the slot.

13. The portable tow device of claim 12, wherein the first bearing member rotates about the second bearing member to clamp the towline between the first and second bearing members when the tow device is actuated into the locked position.

14. The portable tow device of claim 10, further comprising a coupling member having a first end removably fastened to the handle and a second end selectively attachable the person to assist in propelling the person along the surface.

15. The portable tow device of claim 14, wherein the coupling member is a T-bar reversibly fastened to the handle.

16. The portable tow device of claim 14, wherein the coupling member comprises a buckle and a tab fastener, wherein the tab fastener is adapted to be selectively attached to a person and the buckle is reversibly fastened to the handle, the buckle is adapted to be releasably fastened to the tab fastener.

17. A portable tow device for selective attachment to a towline having a length and moving at a predetermined rate, the tow device comprising:

(a) a handle;

(b) a locking member rotatably attached to the handle;

(c) a lever arm fastened to the locking member for selectively rotating the locking member at least 180° about a pivot point between a locked position, wherein the locking member is clamped to the towline for propelling a person along a surface at a rate substantially equal to the rate of the towline, and an unlocked position, wherein the towline passes freely through the tow device; and (d) a coupling apparatus having a first portion fastened to the handle and a second portion selectively attachable the person to assist in propelling the person along the surface.

18. The portable tow device of claim 17, wherein the locking member comprises first and second bearing members and an elongate slot.

19. The portable tow device of claim 18, wherein the elongate direction of the slot extends substantially parallel with the length of the towline when the tow device is in the unlocked position, and the elongate direction of the slot extends substantially normal to the length of the towline when the tow device is in the locked position.

20. The portable tow device of claim 19, wherein the first and second bearing members are elongate cylinders and are held in spaced parallel disposition on opposite sides of the elongate slot, such that the elongate direction of each bearing member is substantially normal to the elongate direction of the slot.

21. The portable tow device of claim 20, wherein the first bearing member rotates about the second bearing member to clamp the towline between the first and second bearing members when the tow device is actuated into the locked position.

22. The portable tow device of claim 17, wherein the first position of the coupling apparatus is a buckle reversibly fastened to the handle and the second portion is a tab fastener, wherein the buckle is adapted to be releasably fastened to the tab fastener.

* * * * *